US010072435B2

(12) United States Patent
Lisin et al.

(10) Patent No.: US 10,072,435 B2
(45) Date of Patent: Sep. 11, 2018

(54) METHOD FOR THERMALLY INSULATING RESERVOIRS

(71) Applicants: Oil Transporting Joint Stock Comapny "Transneft", Moscow (RU); Joint-stock company "Transneft Siberia", Tyumen (RU); L.L.C. "Transneft Research and Development Institute for Oil and Oil Products Transportation", Moscow (RU)

(72) Inventors: Yury Viktorovich Lisin, Moscow (RU); Pavel Olegovich Revin, Aprelevka (RU); Vitaly Ivanovich Surikov, Balashikha (RU); Anatoly Evgenevich Soshchenko, Moscow (RU)

(73) Assignees: PUBLIC-JOINT STOCK COMPANY "TRANSNEFT", Moscow (RU); JOINT-STOCK COMPANY "TRANSNEFT SIBERIA", Tyomen (RU); LIMITED LIABILITY COMPANY "TRANSNEFT RESEARCH AND DEVELOPMENT INSTITUTE FOR OIL AND OIL PRODUCTS TRANSPORTATION", Moscow (RU)

( * ) Notice: Subject to any disclaimer, the term of this patent is extended or adjusted under 35 U.S.C. 154(b) by 0 days.

(21) Appl. No.: 15/226,884

(22) Filed: Aug. 2, 2016

(65) Prior Publication Data

US 2017/0107733 A1 Apr. 20, 2017

Related U.S. Application Data

(63) Continuation of application No. PCT/RU2014/000213, filed on Mar. 28, 2014.

(51) Int. Cl.
*E04H 7/04* (2006.01)
*E04B 1/78* (2006.01)
(Continued)

(52) U.S. Cl.
CPC ..... *E04H 7/04* (2013.01); *E04B 1/762* (2013.01); *E04B 1/78* (2013.01); *F17C 13/001* (2013.01); *F17C 2260/033* (2013.01)

(58) Field of Classification Search
CPC ... E04H 7/04; E04B 1/78; E04B 1/762; F17C 2223/0161; F17C 2260/033; F17C 13/001;
(Continued)

(56) References Cited

U.S. PATENT DOCUMENTS 1,972,508 A * 9/1934 Zeiner ..... F16L 59/14 138/147
3,122,259 A 2/1964 Meesen
(Continued)

FOREIGN PATENT DOCUMENTS

CN 204693030 10/2015
CN 205118646 3/2016
(Continued)

OTHER PUBLICATIONS

Dickey, Allen; "*Cellular Glass on LNG Systems*"; Insulation Outlook Magazine, Aug. 2015, http://www.insulationoutlook.com/io/article.cfm?id=IO150801; (8 pages).
(Continued)

*Primary Examiner* — Paola Agudelo
*Assistant Examiner* — Omar F Hijaz
(74) *Attorney, Agent, or Firm* — One LLP; Jonathan Jaech

(57) ABSTRACT

The invention is directed to a method of insulating tanks having a capacity between 200 $m^3$ and 20,000 $m^3$ used for
(Continued)

storage of oil and oil products. In the method, foundation elements, including tank bottom heat insulation, are prepared. The tank is mounted on the prepared foundation, then insulation of the tank walls and roof is installed. Supporting relieving skirts are mounted on the tank walls and roof, forming tiers. The tiers are filled with foam glass blocks having expansion joints. A top coat of metal sheets is mounted on the outer surface of the blocks. Foam glass blocks in the lower tier are made to be removable to provide access to a "wall-bottom" corner weld joint, and the blocks of the remaining tiers are fixed to the tank surface and interconnected with an adhesive material.

17 Claims, 3 Drawing Sheets

(51) Int. Cl.
*E04B 1/76* (2006.01)
*F17C 13/00* (2006.01)

(58) Field of Classification Search
CPC ..... F17C 2203/0629; F17C 2270/0107; F17C 2203/0329; F17C 2201/0104
See application file for complete search history.

(56) References Cited

U.S. PATENT DOCUMENTS

| | | | | |
|---|---|---|---|---|
| 3,246,479 | A | 4/1966 | Kelley | |
| 3,378,162 | A | 4/1968 | Smith | |
| 3,935,957 | A * | 2/1976 | Hasegawa | F17C 3/022 220/1.5 |
| 3,952,469 | A | 4/1976 | Dudzinski | |
| 3,987,925 | A * | 10/1976 | Sattelberg | B65D 90/06 220/560.08 |
| 4,045,922 | A * | 9/1977 | Elliott | B60P 3/32 52/408 |
| 4,062,468 | A * | 12/1977 | Bongiovanni | B65D 90/06 220/567.2 |
| 4,065,019 | A | 12/1977 | Letourneur et al. | |
| 4,073,976 | A | 2/1978 | Dudzinski | |
| 4,116,150 | A * | 9/1978 | McCown | B63B 25/16 114/74 A |
| 4,155,787 | A | 5/1979 | DeSadier | |
| 4,555,283 | A | 11/1985 | Thesenfitz | |
| 5,154,029 | A * | 10/1992 | Sturgeon | E06B 7/14 52/235 |
| 6,035,795 | A | 3/2000 | Dhellemmes et al. | |
| 6,199,497 | B1 | 3/2001 | Dhellemmes et al. | |
| 6,360,545 | B1 * | 3/2002 | Goldstone | E04H 7/18 52/404.2 |
| 7,171,916 | B2 | 2/2007 | Yang et al. | |
| 8,317,056 | B2 | 11/2012 | Lee et al. | |
| 8,381,939 | B2 | 2/2013 | Schultz et al. | |
| 8,603,375 | B2 | 12/2013 | Simmons et al. | |
| 8,615,946 | B2 | 12/2013 | Oberg | |
| 8,783,501 | B2 | 7/2014 | Mookerjee | |
| 9,027,304 | B2 | 5/2015 | McClure | |
| 2007/0181586 | A1 | 8/2007 | Van Ootmarsum et al. | |
| 2007/0289966 | A1 * | 12/2007 | Morrison | B05D 1/06 220/62.22 |
| 2011/0168722 | A1 | 7/2011 | Baudat et al. | |
| 2012/0325821 | A1 | 12/2012 | Mookerjee | |
| 2013/0180996 | A1 | 4/2013 | Lee et al. | |
| 2014/0255628 | A1 | 9/2014 | Fesmire | |
| 2015/0369428 | A1 | 12/2015 | Ducoup et al. | |

FOREIGN PATENT DOCUMENTS

| | | | |
|---|---|---|---|
| GB | 907860 | | 10/1962 |
| JP | 2001081896 | A * | 3/2001 |
| KR | 101207894 | | 4/2012 |
| RU | 2079620 | | 5/2007 |
| RU | 117467 | | 6/2012 |
| RU | 2558907 | | 8/2015 |
| WO | WO1988/003630 | | 5/1988 |
| WO | WO2015/052446 | | 4/2015 |
| WO | WO2016/046487 | | 3/2016 |
| WO | WO2016/097578 | | 6/2016 |

OTHER PUBLICATIONS

Vertical Tank Insulation Systems by Pittsburgh Corning; "*Vertical Tank (Walls & Roofs)*"; http://www.industry.foamglas.com/en/industry/applications/tanks_spheres_vessels/vertical_systems/; printed Jul. 20, 2016; (4 pages).

"*Foamglass Used as an Insulator in LPG Storage Reservoirs*"; Tech Du Petrol, vol. 21, No. 239, pp. 41-42, Mar. 1966 (in French); (2 pages).

Pittsburgh Corning Foamglass Insulation; "*Foamglass Cellular Glass Insulation is Proven Value*"; (12 pages).

Dudzinski, S. J.; "*Method for Capping Cellular Glass Blocks for the Load Bearing Insulation of Liquefied Gas Storage Tanks*"; SciTech Connect, Feb. 17, 1978; (2 pages).

* cited by examiner

METHOD FOR THERMALLY INSULATING RESERVOIRS

CROSS-REFERENCE TO RELATED APPLICATIONS

This application claims the benefit and priority of PCT Pat. App. No. PCT/RU2014/000213, titled METHOD FOR THERMALLY INSULATING RESERVOIRS and filed on Mar. 28, 2014, also published as WO/2015/147678.

FIELD

The invention relates to heat insulation technology, in particular a method for thermally insulating tanks for storage of oil and oil products including tanks stored in severe climatic conditions (such as relatively low temperatures).

BACKGROUND

The task of storing oil in tanks is important and relevant to many of industries including oil production, energy, mechanical engineering, and the like. Often, oil and oil products are stored in metal tanks for relatively long periods of time. Thus, the task of oil storage in tanks includes many subtasks that are based on properties of oil. One such subtask is heat insulation of tanks. Because oil may freeze at temperatures between −60 degrees Celsius (−60° C.) and 30° C., and because it may begin to boil at temperatures as low as 28° C., depending on its contents, requirements for controlling the temperature inside the tank are relatively strict. Moreover, the task of heat insulation is significantly complicated in oil producing sites with harsh and often extreme natural conditions.

To resolve the task of tank heat insulation, the range of materials and structures varies significantly depending on natural conditions and other factors. Traditionally, polyurethane, mineral wool plates, cellular glass, and the like are used as heat-insulating materials. Cellular glass is the most suitable material in extreme weather conditions. This is because heat-insulating and mechanical characteristics of cellular glass do not change over a relatively large range of temperatures and humidity. Another important factor is that cellular glass is a noncombustible material. The high risk of fire associated with oil and oil product tanks is taken into account during selection of materials and heat-insulating methods.

Various solutions are known in the art for insulation of such tanks.

U.S. Pat. No. 4,073,976 (published on 14 Feb. 1978, IPC F17C13/00) discloses a tank (for storage of the liquefied gas) where foam glass blocks are used as a load-bearing insulation at a bottom of the tank. The blocks are covered by a layer of vermiculite particles that provide for higher resistance to a pressure load.

U.S. Pat. No. 4,062,468 (published on 13 Dec. 1977, IPC B65D90/06) discloses an insulation system for big tanks that store fuel. The aim of the disclosure is to increase the cost effectiveness of insulation and its resistance to natural effects. The insulation includes panels of foam glass insulating material fixed on the tank wall and supported by metal rails. A layer of resinous material reinforced by fiber cloth is positioned on an exterior of the insulation.

U.S. Pat. Pub. No. 2012/0325821 (published on 27 Dec. 2012, IPC F17013/00) discloses a cryogenic tank that includes a welded internal tank and an outer shell that surrounds the welded internal tank. The tank also includes concrete foundation that includes a raised part. The tank also includes multiple cellular glass blocks installed on the raised part of the concrete foundation and a leveling concrete layer that coats the top layer of the foam glass blocks. The tank also includes a fastening device fixed in the concrete foundation. The welded internal tank is installed on the leveling concrete layer and an external shell is fixed on the fastening device along the perimeter of the external shell. The annular space between the internal tank and the external shell is filled with perlite.

R.F. patent No. 117467 (published on 27 Jun. 2012, IPC E04B1/76) discloses a heat-insulated coating that includes \foam glass blocks made in shape of a compressed prism. Liquid ceramic heat insulation is used to fasten foam glass blocks to the foundation of the protected structure and to each other.

U.S. Pat. No. 8,381,939 (published on 26 Feb. 2013, IPC E03B11/00) discloses an insulated storage facility that includes modular panels and structures that are stiff enough to store hot and cold liquids. The insulated storage facility is includes multiple insulating panels installed on an insulated supporter to form a cylindrical wall. Insulating panels have a relatively hard structure and support an internal pad. The cylindrical wall of insulating panels is supported by a thin external case. This insulated storage facility also includes a lid supported by insulating panels and that covers the contents of the storage facility.

However, known technical solutions do not provide structural elements that compensate for deformations of the wall of the protected structure during its operation. If deformations of the tank wall appear, the risk of destruction of the heat-insulated layer is high. Moreover, solutions do not provide the quick access to the surface of the tank for its technical maintenance and repair.

U.S. Pat. No. 8,615,946 (published on 31 Dec. 2013, IPC E04B7/00) discloses an insulated wall system that may be used as heat insulation of industrial structures. Heat insulation includes heat-insulating blocks made of any insulating material known in this field, including but not limited by polystyrene, polyurethane, polyisocyanurate, their mixtures, or the like. The insulated wall system includes many metal gratings installed parallel to and separated from each other. The system also includes multiple external panels, each of which is attached to metal gratings formed on the external coating. The system also includes multiple heat-insulating blocks each of which is installed between the metal grating and the external panel. The system also includes a plank between the heat-insulating blocks and the external panel, the plank having a step that fixes the heat-insulating block and decreases mutual side movements of the heat-insulating block and the plank. The system also includes a fastener that fastens the external panel, the plank and the heat-insulating block together with the metal grating. An adhesive layer may be used between the block and the metal grating to make the assembly of the insulated wall simpler. The adhesive material may include, for example, contact adhesives, reactive adhesives (for instance, epoxy resin, acrylate etc.), pressure sensitive adhesives, hot-melt adhesives, or the like.

The drawback of this technical solution is that the structure is extra hard, which may lead to destruction of the hard heat-insulating material where the tank wall has been deformed during operation.

The technical solution that is the closest to the present solution is a heat-insulated tank known disclosed by RF patent No. 2079620 (published on 20 May 2007, IPC E04H7/04). The tank includes elements tightly fixed on the tank body as horizontal bandages with a coat, and heat-insulating panels installed on them. The bandages are made as angles, fixed on the tank body using preassembled supports. The bandages are along a height of the body at distances between 2 meters (m) and 4 m above each other. The heat-insulating panels are formed as semi-hard mineral or slaggy blocks.

However, this technical solution does not provide adequate strength and safety of the tank heat insulation under loads caused by filling or discharge of the raw material or by environmental factors.

SUMMARY

The object of the invention is to provide a method for insulating tanks, taking into account the cyclic load on the tank framework (for example, loads due to filling and emptying the tank with oil and oil products), in difficult climatic conditions with temperatures that reach negative 60 degrees Celsius (60° C.) while preserving the safety of the heat insulation and achieving the temperature requirements of the stored fluid.

The result of the method is increased strength of the heat insulation of the tank under loads applied to its framework (stated differently, the result is an increased resistance to deformation). The loads may be caused by loading and discharging of raw material as well as climatic factors. The method also preserves temperature of the stored product ensures security of the heat insulation. In addition, the application of the proposed method protects soil (such as preventing thawing of permafrost) from heat of the product that is stored in the reservoir, and allows the insulation of the tank to be dismantled and reinstalled for maintenance and repair.

The method includes preparing foundation elements of the tank with bottom heat insulation, mounting of the tank on a prepared foundation, installing tank walls and insulation and a roof and roof heat insulation. Heat insulation for the tank walls and roof is carried out by fixing a supporting relieving skirt on the tank walls and roof such that they form tiers. The tiers are then filled from the bottom up with heat insulating material such as cellular glass blocks.

The glass blocks include a row in a lower tier between a lower supporting skirt and the tank bottom annular plate. The cellular glass blocks in this location are removable, enabling a user to remove the blocks to gain access to a corner weld joint "wall-bottom". Other tiers of the side wall and the roof are filled with cellular glass blocks which are attached to the surface of the tank and to each other using an adhesive material. The blocks are placed in several rows with various adjacent rows offset from each other. A cruciform, or cross, shaped recess is formed in the block on the tank mounting side to receive the adhesive material. The removable blocks of the lower layer or tier are made with shock-absorbing pads placed on the block's end sides so that they snugly fit with each other. The shock-absorbing pads allow the lower blocks to be removed. A metal plate is fixed on the outer surface of the blocks to protect the blocks from mechanical damage. Vertical expansion joints are made in the blocks other than the lower tier blocks by installing blocks such that a gap remains between adjacent blocks. At least one horizontal expansion joint is also formed in the blocks. The vertical expansion joints are located in each layer, except for the lower tier. Expansion joints are formed on the tank roof in each tier and oriented radially relative to the tank roof. The expansion joints are filled with butyl-rubber sealant. A top coat of metal sheets is placed on the outer surface of the cellular blocks, except for the lower layer, to protect the blocks from mechanical stress.

Supporting relieving skirts are fixed on the wall and the tank roof at a distance of between 1.5 meters (1.5 m) and 2 m of each other.

The supporting relieving skirts are mounted on the tank wall and roof using fasteners made of the same material as the tank. The fasteners include a plate that is welded perpendicular to the plane of a plate support platform of the tank, for example, via welding. The supporting relieving skirt is made in the form of beams or corners.

Supporting relieving skirt fasteners are welded to the tank surface at distances of 1.5 m or less on the perimeter of the side wall and around the circumference of the roof.

Top coat metal sheets are attached to the supporting relieving skirts using self-tapping screws with sealing rubber gaskets.

The foam glass blocks for insulation of the tank walls and roof have the following characteristics: a thermal conductivity of no more than 0.05 watts per square meter of surface area for a temperature gradient of one kelvin for every meter thickness (0.05 W/mK), a vapor permeability of 0 mg/mhPa, being in the NG flammability group, a crushing strength of at least 0.7 Megapascals (MPa), and a density of between 115 kilograms per cubic meter (kg/m$^3$) and 180 kg/m$^3$.

The foam glass blocks in each row of each tier are displaced relative to adjacent rows by a distance of half of their length.

Shock absorbing pads of the foam glass blocks of the lower layer are made using a cellular rubber substance having a thickness of between 20 mm and 25 mm. The cellular rubber substance may include for example, cellular rubber available under the brands K-Flex, Armaflex, and may be fixed on the perimeter of the block.

The metal plate coupled to the outer surface of the blocks protects the blocks from mechanical stress. The plate includes galvanized steel having a thickness of 0.7 mm with a tolerance of 0.08 mm. The outer surface of the plate has a corrosion-resistant coating.

The adhesive material is filled in the cross-shaped recess in the foam glass block and protrudes by between 8 mm and 12 mm above the surface of the block for subsequent bonding to the tank surface.

A polyurethane sealant, such as a grade 3M, is used as the adhesive material for mounting the foam glass blocks to the tank surface and to each other.

The tank has a volume from between 200 meters cubed (200 m$^3$) and 20,000 m$^3$.

The size of the gap for forming the vertical and horizontal expansion joints is 20 mm plus or minus 3 mm.

At least three supporting relieving skirts are fixed on the tank wall.

Vertical expansion joints are positioned at intervals of between 4.5 m and 5.5 m about the tank perimeter, and the horizontal joint is placed between a second and a third supporting relieving skirts.

The sheets of galvanized steel having a thickness of 0.7 mm with a permissible deviation of 0.08 mm and having an anticorrosive coating are used as the tank walls and roof top coat to protect the blocks from mechanical impacts.

The tank wall top coat includes profiled galvanized steel sheets and the tank roof top coat includes smooth galvanized steel sheets. The sheets are fastened using self-tapping screws at a distance therebetween of 300 mm plus or minus 5 mm, and the overlap of the top coat sheets are connected using aluminum pop-rivets at a distance therebetween of 300 mm plus or minus 5 mm.

The top coat sheets are bonded to the foam glass blocks using the adhesive.

The cross-shaped notch has a cross-sectional shape in the form of a semicircle having a diameter of 20 mm, with permissible tolerance of 2 mm.

The preparation of the foundation having the heat insulation elements for the tank bottom includes installing reinforced concrete pilework, laying a leveling blanket on the concrete pilework, coating the leveling blanket with bituminous mastic, laying the foam glass blocks on the leveling blanket, filling the joints between the blocks with bituminous mastic, and laying a waterproofing layer upon the foam glass blocks.

Foam glass blocks with following characteristics are used in the foundation: a thermal conductivity of no more than 0.05 watts per square meter of surface area for a temperature gradient of one kelvin for every meter thickness (0.05 W/mK), a vapor permeability of 0 mg/mhPa, being in the NG flammability group, a crushing strength of at least 0.9 Megapascals (MPa), a density of between 130 kilograms per cubic meter ($kg/m^3$) and 180 $kg/m^3$, a length and width of about 450 mm by 600 mm and thickness of between 40 mm and 180 mm.

The leveling blanket includes a layer of cement screed or medium-grain sand having a thickness of at least 50 cm.

The waterproofing layer includes bituminous concrete, for example, of grades I-III and having a thickness of 1 between 1 mm and 3 mm.

The joints between the blocks of the foundation are filled with bitumen mastic having a width of 3 mm plus or minus 1 mm.

A canopy that juts out of the roof includes a coated layer of the roof formed at the connection of the roof with the wall top coat.

The heat insulation is installed on tank structural elements such as pipe branches and manholes.

Collars of steel sheet having a thickness of 5 mm are installed on the pipe branches and manholes on the tank wall and roof.

A cover sheet is mounted to the collars of the tank pipe branches and manholes using self-tapping screws.

Weatherproof anticorrosive coatings that are based on epoxy and polyurethane are used as an anticorrosive coating.

BRIEF DESCRIPTION OF THE DRAWINGS

The features of the disclosure are illustrated by the following drawings.

DETAILED DESCRIPTION

Figure 1:
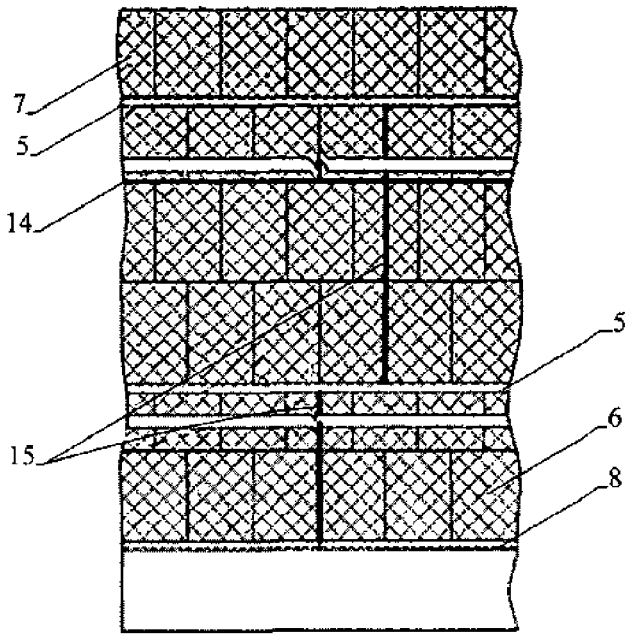
FIG. 1 illustrates a front side view of a scheme of the heat insulation on the tank wall.

The drawings include the following elements along with their corresponding reference numbers:

1.—tank bottom,
2.—tank wall,
3.—tank roof,
4.—the tank pipe branches and manholes,
5.—the tank supporting relieving skirt,
6.—the tier between supporting relieving skirts,
7.—cellular glass blocks for heat insulation of tank walls and roof,
8.—lower supporting relieving skirt,
9.—corner weld joint "wall-bottom" of the tank (annular plate of the tank bottom),
10.—removable cellular glass blocks,
11.—shock-absorbing sealing gaskets for the removable blocks,
12.—removable block metal plate,
13.—adhesive material,
14.—tank wall horizontal expansion joint,
15.—tank wall vertical expansion joint,
16.—tank wall heat insulation top coat (smooth metal sheet),
17.—tank roof heat insulation top coat (corrugated metal sheet),
18.—fastening element plate,
19.—the support platform for mounting the supporting relieving skirt,
20.—galvanized self-tapping screws with sealing rubber gaskets,
21.—pop rivet,
22.—reinforced concrete pilework,
23.—leveling blanket,
24.—a layer of bituminous mastic,
25.—foam glass blocks for tank bottom heat insulation,
26.—waterproofing layer,
27.—tank roof canopy,
28.—collars of the pipe branches and manholes on the tank wall and roof,
29.—an underlay sheet of the pipe branches and manholes of the tank, and
30.—a cover sheet of the pipe branches and manholes of the tank.

The claimed method is carried out as follows.

The foundation (base) is prepared, which includes the installation of a cylindrical tank, including the installation of a bottom 1 of the tank, a wall 2 of the tank, and a roof 3 of the tank. Then, supporting structures are mounted on the tank wall and roof for aiding in installation of, and supporting, heat insulating material. The supporting structures include supporting relieving skirts 5 that form tiers 6 (with brief reference to FIG. 1). Supporting relieving skirts 5 are made, e.g. of steel, in the form of beams or corners. In this case, the supporting relieving skirts are attached to the wall around the perimeter of the tank and to the roof in concentric circles at distances of between 1.5 m and 2 m of each other. If the distance between skirts exceeds 2 m, deformation of the heat insulating material may occur. If the distance between the skirts is less than 1.5 m, the specific consumption of metal for the structure significantly increases. The number of supporting relieving skirts mounted on the tank wall and roof is determined based on the geometric dimensions of tanks of different capacities.

Figure 7:
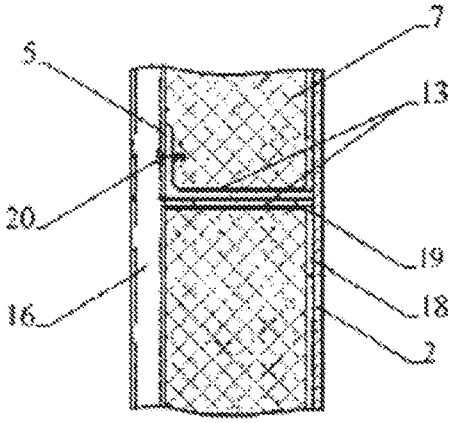
FIG. 7 illustrates a scheme for fastening of supporting discharge skirts.

The supporting relieving skirts 5 are mounted using fasteners made of the same material as the tank (steel), and include a plate 18 welded to a plate support platform 19 and oriented perpendicular to the plane of the plate support platform 19 (with brief reference to FIG. 7). The plate support platform 19 supports the plate 18. Supporting relieving skirt fasteners are welded to the tank surface at distances of 1.5 m or less therebetween on the perimeter of the side wall and around the circumference of the roof. After the installation of the fastening elements, the tank outer surface and the supporting structure for the heat insulation are protected by weather resistant anticorrosive coatings.

Then, the foam glass blocks (including, for example, cellular glass) 7 are set on the base of the supporting relieving skirt 5 by tiers starting from the bottom. A lower tier—between the lower supporting relieving skirt 8 and the annular plate of the tank bottom 9 (around the corner weld joint)—one row of foam glass blocks 10 are installed and made removable. This provides the ability for quick extraction of the blocks 10 for easy access to a corner weld joint "wall-bottom" 9.

Figure 6:
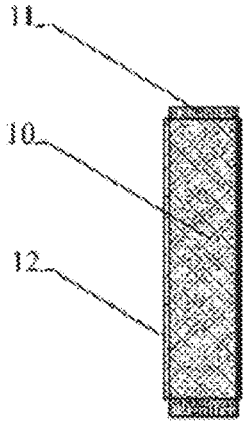
FIG. 6 illustrates generally a quick-detachable heat-insulating element of a corner weld joint in a "wall-bottom" of a tank.

Removable blocks 10 of the lower layer are made with a shock-absorbing sealing gasket 11 (with brief reference to FIG. 6) having a thickness between 20 mm and 25 mm. The gasket 11 is made, for example, using a cellular rubber substance (such as foam rubber) of brands K-Flex or Armaflex. The sealing gaskets are glued around the perimeter of the block onto its end sides (bottom, top and the two side), allowing the blocks to snugly fit with each other. The gasket also allows the blocks 10 to be removable.

A metal plate 12 in the form of a smooth galvanized steel sheet, being 0.7 mm thick with a tolerance of 0.08 mm, is made to have an anticorrosive coating on the outside. The plate 12 is coupled to the outer (front) surface of the removable blocks 10 using bituminous mastic and protects the blocks against mechanical impacts. For protection against mechanical impacts, installation of a metal plate with anticorrosive coating may also be positioned on the inner surface of the block. The size of the removable blocks is determined based on the location of lower supporting skirt.

Other wall tiers and the roof of the tank are filled with additional foam glass blocks, which are attached to the tank surface and to each other using an adhesive material 13. The adhesive material may include, for example, a Polyurethane sealant of grade 3M. The joints between adjacent blocks and between blocks and the tank structural elements are filled with polyurethane sealant applied around the blocks perimeter. The layer of polyurethane sealant may have a width of 3 mm plus or minus 1 mm that provides a balance between strength and flexibility of construction. The blocks are placed in several rows with offset blocks in adjacent rows, as shown in FIG. 1. The offset may be, for example, half of a block length.

The cuboid foam glass blocks are formed with a cruciform recess on a side that contacts the tank. The cruciform recess is formed to have two grooves (cavities) intersecting at right angles in the center of the side of the block that is in contact with the tank surface. The grooves have a cross-sectional shape in the form of a semicircle having a diameter of 20 mm with a tolerance of 2 mm, and pass along the entire surface of the block to the ribs. To mount the blocks to the tank surface, the cruciform recess is completely filled with polyurethane sealant, and the adhesive material protrudes beyond the block by between 8 mm and 12 mm to provide an improved coupling of the block with the tank surface.

The walls and roof insulating blocks 7 are foam glass blocks having dimensions of 450 mm by 300 mm and a thickness of between 25 mm and 125 mm. The insulating blocks 7 have the following characteristics: a thermal conductivity of no more than 0.05 watts per square meter of surface area for a temperature gradient of one kelvin for every meter thickness (0.05 W/mK), a vapor permeability of 0 mg/mhPa, being in the NG flammability group, a crushing strength of at least 0.7 Megapascals (MPa), and a density of between 115 kilograms per cubic meter ($kg/m^3$) and 180 $kg/m^3$.

Installation of the heat insulation is performed scaffolding. When the heat insulation is mounted along a tank section perimeter, the scaffolding is moved by the tank generatrix, and heat insulation is mounted on the entire height of an adjacent section.

Figure 2:
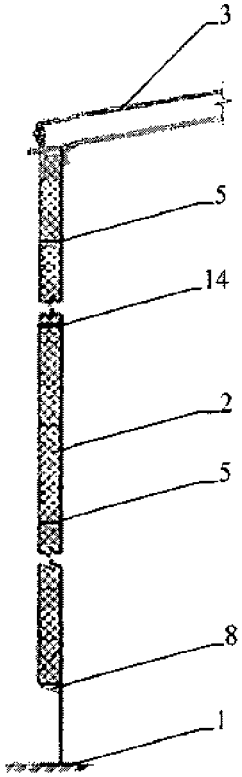
FIG. 2 illustrates a side view of the scheme of the heat insulation on the tank wall of FIG. 1.

When mounting blocks on the tank surface, the expansion joints are formed by installing blocks and/or their partial blocks with a gap therebetween, which is filled, for example, with butyl rubber sealant of grade 3M. In this case, at least one horizontal expansion joint 14 is formed on the tank wall. At least 10 vertical joints 15 are formed being in each section (with brief reference to FIGS. 1, 2). At least ten expansion joints are formed on the tank roof in each tier and are oriented radially. The size of the gap for the formation of expansion joints is 20 mm plus or minus 3 mm.

Vertical expansion joints 15 are positioned, for example, at 5 m intervals along the tank perimeter, and the horizontal joint 14 is placed, for example, between the second and the third supporting relieving skirts (such as in the middle of the two skirts). To ensure the continuity of the wall vertical expansion joints with the roof expansion joints of the tank, foam glass blocks are cut while in place.

Thus, the location of expansion joints, the material they filled with, and the size of the joints compensate for deformation of the tank under external mechanical stress, preserving the integrity of the heat insulation.

The metal sheet coating layers 16, 17 are mounted on the outer surface of the foam glass blocks 7 of the tank wall and roof and protect the blocks 7 from mechanical damage and environmental influences. The metal sheet coating layers 16, 17 include sheets of galvanized steel having a thickness of 0.7 mm with a permissible deviation of 0.08 mm, and are made to have anticorrosive coating on the outside. Profiled (i.e., corrugated) sheets having a thickness between 10 mm and 35 mm, and a width of not less than 1,000 mm, are used for the top coat 16 of the tank wall heat insulation. Smooth sheets having a minimum width of 1,000 mm are used for the top coat 17 of the roof heat insulation.

Figure 8:
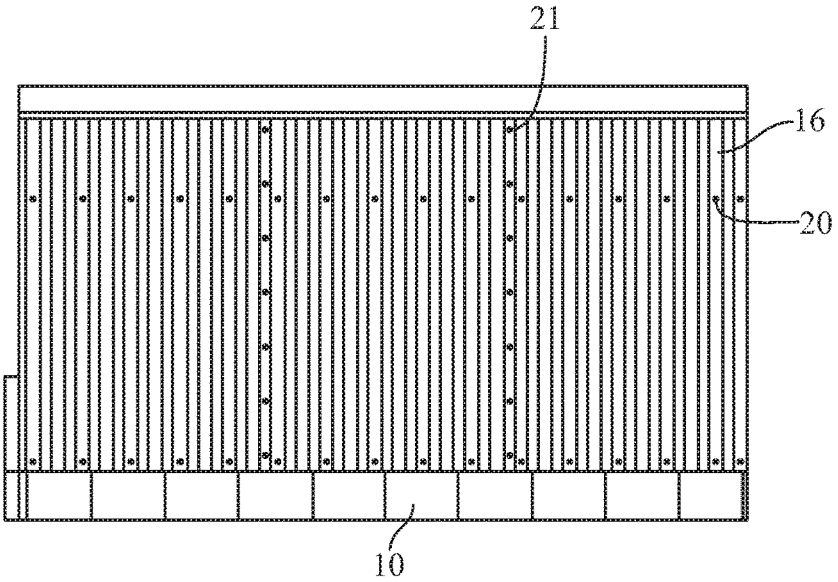
FIG. 8 illustrates a front view of a scheme for fastening of a top coat on a tank wall.

The metal sheets are glued to the foam glass blocks, for example, using a polyurethane sealant, and are fastened to the supporting relieving skirts 5 using galvanized self-tapping screws 20 with sealing gaskets. The screws 20 with sealing gaskets are installed in holes that are jointly drilled in the sheet and the supporting relieving skirt 5 (with brief reference to FIG. 7). The sheets are coupled (i.e., the screws 20 are installed) at a distance of 300 mm plus or minus 5 mm along the tank perimeter, which ensures their snug fit to each other and to the heat insulating layer. The overlap of top coat sheets is connected using aluminum rivets 25 also at a distance of 300 mm plus or minus 5 mm (with brief reference to FIG. 8). The sheets overlap horizontally by a distance of 50 mm plus or minus 5 mm, and by one step of the corrugation profile in the vertical direction. The chosen values preserve the mutual arrangement of sheets and the continuity of the structure at longitudinal and transverse locations of the tank walls.

Figure 3:
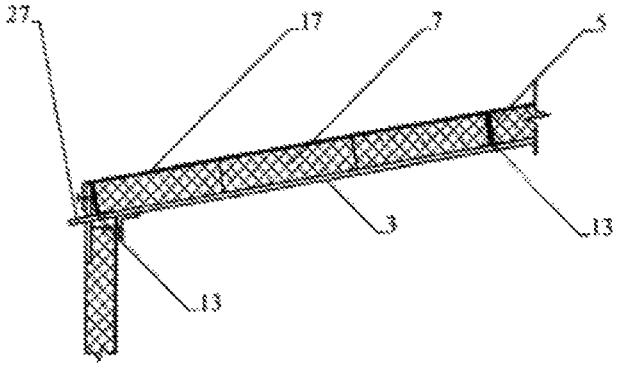
FIG. 3 illustrates a side view of a scheme of heat insulation on a tank roof

The ledge—or canopy 27—on the roof 3 is located at the junction of the roof 2 top coat and the wall top coat to prevent contamination of the tank wall 2 from mud flows (with brief reference to FIG. 3). The lay-in type panels of galvanized steel sheets are mounted to fix the top coat 17 on the surface of the blocks on the tank roof 2. Top coat sheets are attached to lay-in type panels using self-tapping galvanized screws with sealing gaskets that are installed in holes drilled through the sheet and the lay-in panel.

Figure 4:
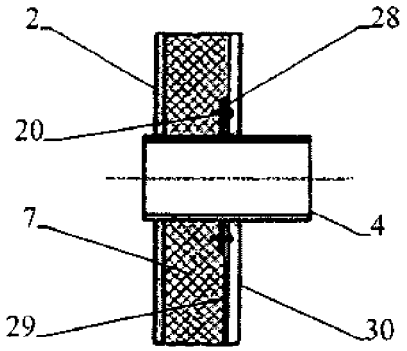
FIG. 4 illustrates a front view of a scheme of heat insulation of lids and pipe branches on a tank wall.

Collars 28 made of sheet steel and having a thickness of 5 mm are welded on the pipe branches and manholes 4 on the tank wall and roof (with reference to FIG. 4). A doubling sheet 29 of galvanized steel is set under a cover sheet 30 to enhance tie-ins of the pipe branches and manholes. The cover sheet 30 for the pipe branches and manholes is mounted to the collar 28 and to the doubling sheet 29 using the self-tapping screws 20. The joint of the backing sheets, cover sheet and collar is sealed using mastic.

Weatherproof anticorrosive coatings that include epoxy and/or polyurethane are used as a top coat anticorrosive coating for the pipe branches and manholes 4 on the wall and roof.

Figure 5:
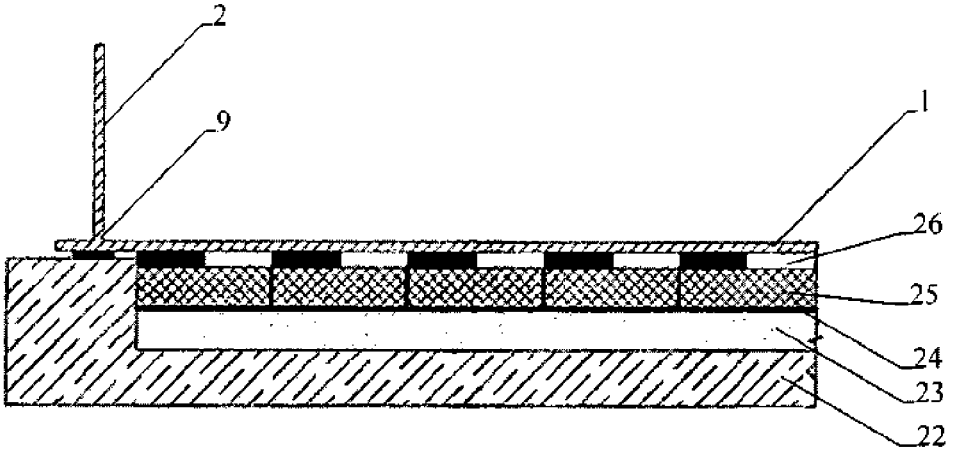
FIG. 5 illustrates a side view of a scheme of heat insulation on a tank bottom.

Installation of the tank bottom heat insulation 1 includes the installation of concrete ring (pilework) 22. A leveling layer 23, intended for leveling the surface for laying the foam glass blocks, is then placed on the concrete ring 22. The leveling layer 23 includes, for example, cement screed or medium-grain sand with a minimum thickness of 50 cm (with brief reference to FIG. 5). The leveling layer is covered with a layer of bitumen mastic 24, and the insulation layer is laid on it. The insulation layer is made of foam glass blocks 25 having dimensions of 600 mm by 450 mm and a thickness between 40 mm and 180 mm. The blocks 25 have the following characteristics: a thermal conductivity of no more than 0.05 watts per square meter of surface area for a temperature gradient of one kelvin for every meter thickness (0.05 W/mK), a vapor permeability of 0 mg/mhPa, being in the NG flammability group, a crushing strength of at least 0.9 Megapascals (MPa), a density of between 130 kilograms per cubic meter (kg/m$^3$) and 180 kg/m$^3$, a length and width of about 450 mm by 600 mm and thickness of between 40 mm and 180 mm. Foam concrete blocks may also be used as the heat-insulating material of the tank bottom.

When mounting the heat insulation layer, the cutting of the foam glass blocks in place is allowed. The joints between the blocks are filled with bitumen mastic (an adhesive for the bottom), the mastic layer having a width of 3 mm plus or minus 1 mm. The waterproofing layer 26 has a thickness between 1 mm and 3 mm, and is designed to protect the tank bottom 1 from surface corrosion and provides the uniform distribution of the load on the heat insulation. The waterproofing layer 26 provides elimination of local stress concentrations in the heat insulation during installation and operation of the tank and is applied on the heat insulating layer. Grades I-III bituminous concrete, for example, is used for the waterproofing layer 26.

The application of the proposed method ensures the preservation of the integrity of the heat insulation in the longitudinal and transverse directions of the tank walls; provides insulation of the tank walls, roof and bottom from the effects of low ambient temperatures; and also prevents cooling of the stored fluid in the tank and thawing of soil. The construction performance of the heat insulation provides the possibility of dismantling and re-assembling for tank maintenance and repair, including the quick access to corner weld joint of the tank walls.

The invention claimed is:

1. A method for providing heat insulation of a tank, comprising:

installing a wall, a roof, and a bottom on a foundation;

coupling supporting relieving skirts to the tank, the supporting relieving skirts defining tiers;

forming a heat-insulated layer by positioning foam glass blocks in the tiers including a lower row of foam glass blocks that include detachable foam glass blocks set on a lower tier of the relieving skirts wherein a shock absorbing sealing gasket, sized for a snug fit with adjacent blocks, is attached around a perimeter of each of the detachable foam blocks, while additional rows of foam glass blocks above the lower row of foam glass blocks are coupled to the tank via an adhesive wherein the blocks of adjacent rows are offset from one another;

forming at least one vertical expansion joint and at least one horizontal expansion joint in the heat-insulated layer;

coupling at least one corrugated metal sheet of galvanized steel having a thickness of 0.7±0.08 mm and an anticorrosive coating on the outside to an outer surface of the additional rows of foam glass blocks above the lower row of foam glass blocks; and fastening the at least one metal sheet to the supporting relieving skirts using screws with sealing gaskets.

2. The method of claim 1, wherein the supporting relieving skirts are mounted on the wall and the roof and separated by between 1.5 meters (1.5 m) and 2 m.

3. The method of claim 1, further comprising mounting the supporting relieving skirts on the wall and the roof using fasteners having a same material as the tank, the fasteners including a plate welded perpendicular to a plane of a plate support platform.

4. The method of claim 1, further comprising attaching the at least one metal sheet to the supporting relieving skirts using a self-tapping screw with a sealing rubber gasket.

5. The method of claim 1, wherein the foam glass blocks of the additional rows are characterized by: a thermal conductivity of no more than 0.05 watts per square meter of surface area for a temperature gradient of one kelvin for every meter thickness (0.05 W/mK), a vapor permeability of 0 mg/mhPa, a crushing strength of at least 0.7 Megapascals (MPa), and a density of between 115 kilograms per cubic meter (kg/m$^3$) and 180 kg/m$^3$.

6. The method of claim 1, wherein forming the heat-insulated layer includes installing foam glass blocks of at least one row to be offset from at least another row of foam glass blocks by a distance equal to half of a length of a foam glass block.

7. The method of claim 1, further comprising forming a recess in the foam glass blocks of the additional rows, filling the recess with an adhesive, and adhering the additional rows of foam glass blocks on the wall or the roof to couple the foam glass blocks to the tanks.

8. The method of claim 1, wherein a polyurethane sealant is used as the adhesive.

9. The method of claim 1, wherein forming the at least one vertical expansion joint includes forming multiple vertical expansion joints around a perimeter of the tank at intervals of between 4.5 m and 5.5 m.

10. The method of claim 1, wherein width of the vertical and horizontal expansion joints is (20±3) mm.

11. The method of claim 1, wherein the shock-absorbing sealing gasket is glued around the perimeter of each of the detachable foam blocks.

12. The method of claim 10, wherein the shock-absorbing sealing gasket has a thickness between 20 and 25 mm.

13. The method of claim 10, wherein the shock-absorbing sealing gasket is made of a cellular rubber material.

14. The method of claim 1, wherein the tank volume is between 200 to 20,000 m3.

15. The method of claim 1, wherein the coupling supporting relieving skirts to the tank comprises coupling at least three supporting relieving skirts.

16. The method of claim 1, further comprising connecting overlapping parts of the at least one metal sheet by pop rivets.

17. The method of claim 1, wherein each of the detachable foam glass blocks is coupled at an outer surface to a metal plate that protects the block from mechanical impact.

* * * * *